United States Patent [19]

Frugé

[11] Patent Number: 5,067,259

[45] Date of Patent: Nov. 26, 1991

[54] PUNTING AND SOCCER-STYLE KICKING SHOE

[76] Inventor: Paul Frugé, 828 W. 46th St., Norfolk, Va. 23508

[21] Appl. No.: 559,141

[22] Filed: Jul. 30, 1990

[51] Int. Cl.[5] ..... A43B 5/02

[52] U.S. Cl. ..... 36/133; 36/128; 36/102

[58] Field of Search ..... 36/133, 128, 113, 102, 36/1

[56] References Cited

U.S. PATENT DOCUMENTS

| | | | |
|---|---|---|---|
| Re. 33,018 | 8/1989 | Ostrander | 36/102 |
| 1,525,848 | 2/1925 | Bonaventure | 36/113 X |
| 1,619,665 | 3/1927 | Gabriel | 36/113 X |
| 1,620,797 | 3/1927 | Bonaventure | 36/113 X |
| 1,754,054 | 4/1930 | Selva | 36/113 X |
| 1,754,996 | 4/1930 | Gant | 36/102 X |
| 2,252,315 | 8/1941 | Doree | 36/102 X |
| 2,400,535 | 5/1946 | Celmer | 36/113 X |
| 2,661,547 | 12/1953 | Hyde et al. | 36/128 |
| 3,525,165 | 8/1970 | Randall, Jr. | 36/128 X |
| 3,703,775 | 11/1972 | Gatti | 36/128 |
| 4,065,861 | 1/1978 | Pelfrey | 36/133 |
| 4,554,749 | 11/1985 | Ostrander | 36/102 |
| 4,615,126 | 10/1986 | Mathews | 36/102 |
| 4,901,453 | 2/1990 | Gaxnor | 36/113 |
| 4,924,606 | 5/1990 | Montgomery | 36/102 X |

FOREIGN PATENT DOCUMENTS

| | | | |
|---|---|---|---|
| 2736974 | 3/1979 | Fed. Rep. of Germany | 36/113 |

OTHER PUBLICATIONS

UK Patent Application BG2060351A (Buckley).

*Primary Examiner*—Paul T. Sewell
*Assistant Examiner*—Ted Kavanaugh
*Attorney, Agent, or Firm*—Foley & Lardner

[57] ABSTRACT

A kicking shoe maintains the proper foot geometry for punting and soccer-style kicking by ensuring proper toe depression during kicking, thereby increasing the accuracy, distance, and repeatability of punts and soccer kicks.

9 Claims, 2 Drawing Sheets

PUNTING AND SOCCER-STYLE KICKING SHOE

FIELD OF THE INVENTION

The invention is directed to sports shoes and particularly to punting and soccer-style kicking shoes.

BACKGROUND OF THE INVENTION

Maintaining a proper kicking angle is a recurring problem for amateur and semi-professional kickers. The proper kicking angle in punting and soccer-style kicking is achieved through toe depression. Toe depression is the angling of the toes and forefoot downward from the rearfoot and ankle, and out of the way of the ball being kicked. Proper toe depression prevents the toes from adversely affecting the flight of the football, which should properly contact only the top of the kicker's foot above the arch.

Previous kicking shoe inventions have been directed toward attachments to the shoes, such as U.S. Pat. Nos. 2,661,547, 3,525,165, and 4,065,861. These inventions add bulk and weight to the shoe, and consist of artificially shaped kicking surfaces on the top of the forefoot These attachments may be unwieldy, hazardous, or illegal, and they ignore the natural kicking motion of a professional punter. These prior art kicking shoes do not teach the use of a shoe construction for achieving proper toe depression.

Because of the lack of a proper kicking shoe, many kickers prefer to kick barefooted, in spite of the risk of injury to their feet. The reason for this is that conventional kicking shoes actually restrain the foot from achieving the proper geometry (i.e., optimum toe depression) for successful kicking. It should be appreciated that a punter must concentrate to maintain his foot at the correct angle for a successful punt. This proper angle may not be achieved for a number of reasons including poor footing, lack of concentration due to a bad snap, or a "lazy ankle" in the kicker.

SUMMARY OF THE INVENTION

In contrast to conventional kicking shoes which actually restrain the foot from achieving the proper kicking angle, the invention actually ensures that this proper angle will be achieved. The instant invention is not a shoe attachment, but a change in the geometry of shoe construction which ensures the proper kicking motion for accuracy, distance, and repeatability.

Proper toe depression is achieved in this invention through a shoe construction in which the front portion of the sole is angled downward from the rear portion of the sole. This construction ensures proper toe depression, and allows a punter to concentrate on the other aspects of his kick. In addition, the sole may be made sufficiently pliable so that it will become flat under the force of normal body weight, so as to allow a kicker to run in an ordinary fashion.

The shoe construction in accordance with this invention may utilize the existing sole and upper components of the shoe, and add no additional material, so that a superior kicking shoe may be produced at little or no additional cost over a conventional shoe.

DETAILED DESCRIPTION OF THE PREFERRED EMBODIMENTS

Figure 1:
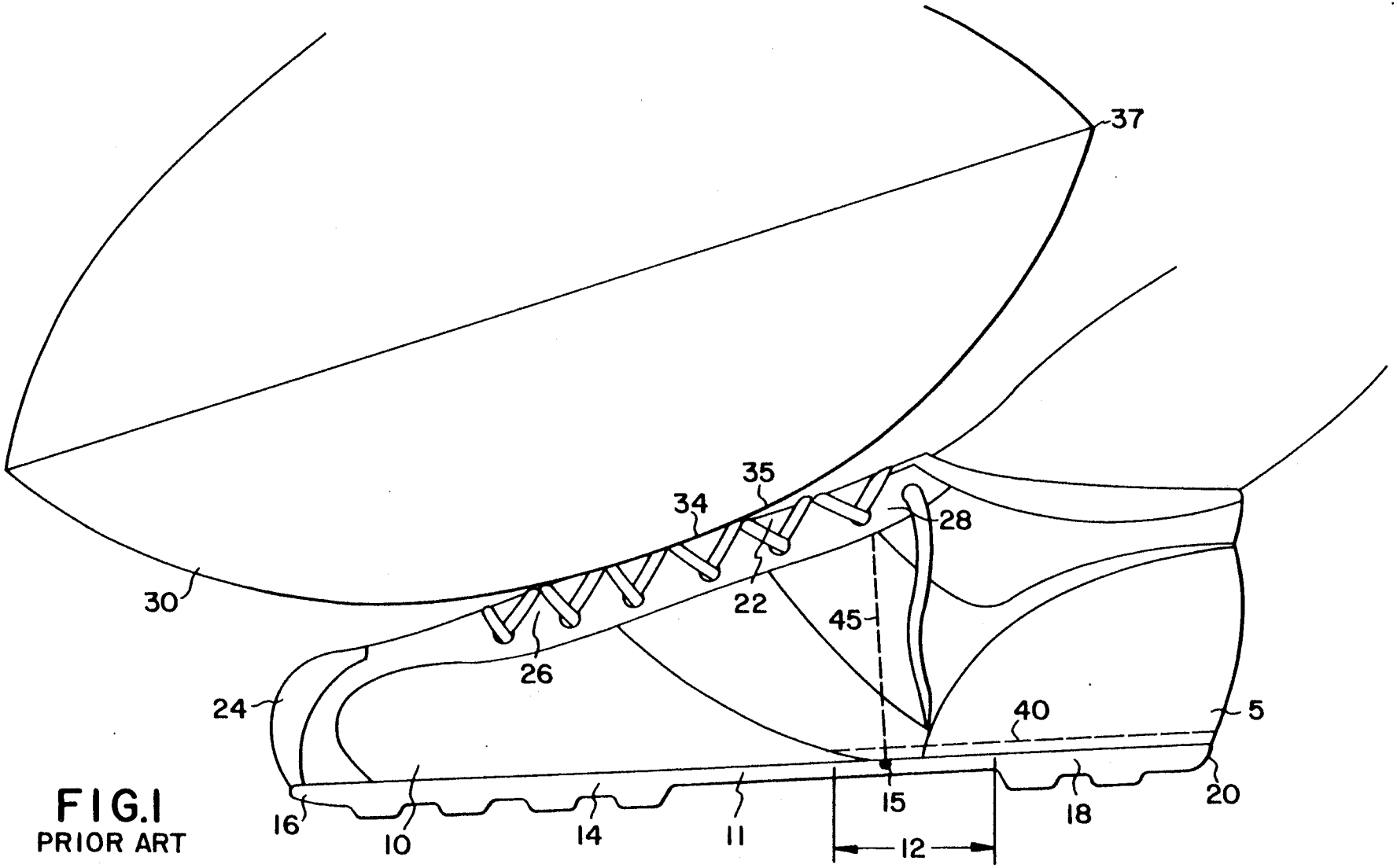
FIG. 1 PRIOR ART
FIG. 1 is a side elevation of a typical kicking shoe in contact with a football.

The use of a typical kicking shoe in punting a football is shown in FIG. 1. The shoe 5 has a shoe upper 10 attached to a sole 11. The sole 11 substantially under the arch of the kicker's foot. A point 15 located in the lower arch region 12 divides the sole 11 into two portions: a front portion 14 extending from point 15 to the front end 16 of the sole 11, and a rear portion 18 extending from point 15 to the rear end 20 of the sole 11. The shoe upper 10 has an upper arch region 22 located on top of the shoe 5 and substantially above the arch of the kicker's foot. The shoe upper 10 also has a toe 24 in the area of the kicker's toes, a front top surface region 26 located above the kicker's foot between the upper arch region 22 and the toe 24, and a lace region 28 where the shoe is tied or otherwise fastened.

The sole 11 is typically somewhat stiff and together with the upper 10 resists toe depression. As a result, kicking toe 24 and front top surface region 26 have an increased likelihood of coming in contact with football 30, thereby interfering with the proper flight of football 30 as it leaves the upper arch region 22.

The ideal area of impact on football 30 is between point 34 and point 35. Point 34 lies on a circle approximately one-third of the way from one end 37 (the end toward the kicker) of football 30 to the opposite end of football 30. Point 35 is approximately one inch from point 34 in the direction of point 37. Because of the conventional construction of punting shoes, the ideal impact area of the football is difficult to achieve in a consistent manner.

Figure 2:
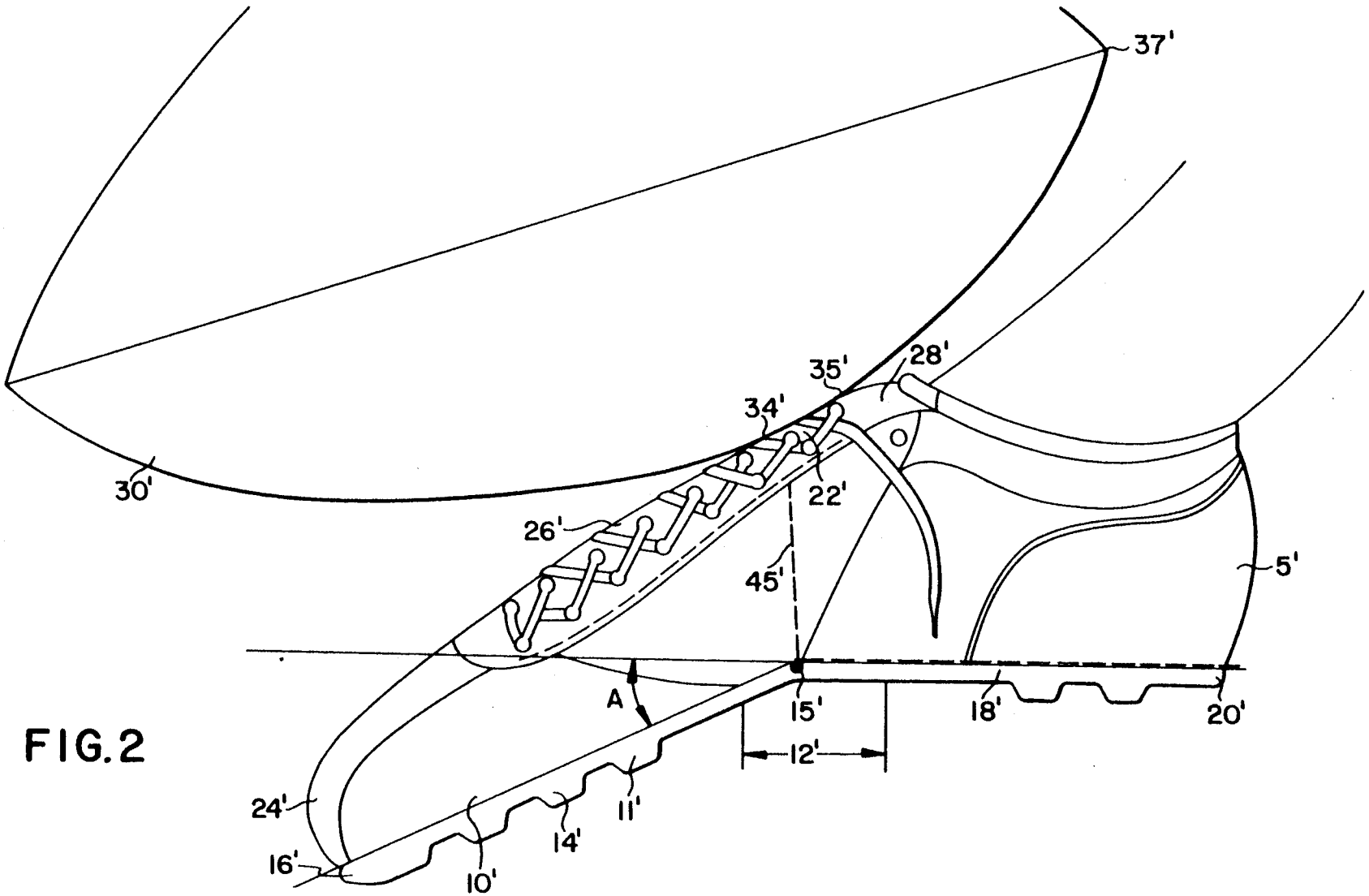
FIG. 2 is a side elevation of an embodiment of the invention.

FIG. 2 illustrates an embodiment of the invention. The shoe 5' has a shoe upper 10' attached to a sole 11'. The sole 11' has a lower arch region 12' which is located substantially under the arch of the kicker's foot. A point 15' located in the arch region 12' divides the sole 11' into two portions: a front portion 14' extending, from point 15' to the front end 16' of the sole 11, and a rear portion 18' extending from point 15' to the rear end 20' of the sole 11'. The shoe upper 10' has an upper arch region 22' located on top of the shoe 5' and substantially above the arch of the kicker's foot. The shoe upper 10' also has a toe 24' in the area of the kicker's toes, and a front top surface region 26' located above the kicker's foot between the upper arch region 22' and the toe 24', and a lace region 28' where the shoe is tied. The sole 11' is angled downward in the vicinity of point 15'. The intersection of a plane containing the rear portion 18' and a plane containing the front portion 14' may be measured by the downward angle A. Downward angle A may be advantageously fixed between 5 degrees and 45 degrees, and is preferably selected to be in the range of 15 to 45 degrees, or more preferably between 20 to 35 degrees, and most preferably between 30 to 35 degrees.

The purpose of the downward angle A is to achieve optimal toe depression and thereby decrease the likelihood that toe 24' or front top surface region 26' will contact football 30' and interfere with its flight.

The toe depression shoe in FIG. 2 may be fabricated from the conventional shoe in FIG. 1 by cutting the conventional shoe, 5 along the dotted line 40 and separating the upper 10 from the sole 11 along the entire region between just forward of point 15 (at the forward end of the lower arch region 12) and the rear end 20 along both sides of the shoe. The upper is then cut along dotted line 45 from the sole 11 at point 15 to the lace region 28 on both sides of the shoe. The shoe is then bent to the desired angle A as in FIG. 2, say 35 degrees, and the upper 10' is re-fastened to the sole 11' while maintaining the depression angle A, such as by clamping in place. This method of fabrication will result in an extended sole in the heel region, which can be cut off. Further, this method of fabrication will result in an overlap of excess upper material along the dotted line 45. This overlap may be left as is, stitched, or glued.

Naturally, the kicking shoe may initially be mass produced with the proper configuration of the upper 10' and sole 11' so that it is not necessary to modify an existing shoe as described above. In such case, sufficient material in the upper 10' when fastened to sole 11' will permit the kicker to easily depress their toe to achieve the desired depression angle without the resistance otherwise present from the taut attachment of upper 10 and sole 11 in a conventional shoe.

A second method of making the toe depression shoe is to begin with a sole 11' which has already been formed with the desired depression angle A. This sole could be manufactured in a number of ways including direct molding or by heat treating and bending existing flat soles to the desired angle. The upper 10' would be cut in the proper shape, and then attached to the bent sole 11'. This differs from the previous embodiment in that the depression angle A is maintained primarily by the construction of the sole 11' rather than by the method of attaching the upper 10' to the sole 11'. In the second embodiment, it is important to construct the sole so that it will flatten out under normal body weight, and yet maintain an optimum depression angle when the foot is raised into the kicking position. This may be achieved by selecting the proper amount of stiffness in the lower arch region 12' of the sole 11'.

A third method of constructing a toe depression shoe is to build the sole 11' in two pieces, one piece corresponding to the front portion 14', and the other piece corresponding to the rear portion 18'. The two sole pieces could then be joined with a rigid piece at the proper depression angle in the lower arch region 12'. The two sole pieces could also be joined by a flexible hinge in the lower arch region 12'. This flexible hinge could further be constructed to maintain a certain tension so as to force the two sole portions toward the proper depression angle, while still allowing the shoe to flatten out while the kicker is running. There may be many variations of the two-piece sole, the goal of which is to allow the shoe to maintain the proper depression angle when kicking a ball.

It should be understood that there may be many ways in which this downward angle A may be obtained by those skilled in the art. Various modifications may be made to this embodiment without departing from the scope of this invention as described in the following claims.

What is claimed is:

1. A kicking shoe for permitting proper kicking of a sports ball comprising:

(1) an upper having:

(a) a top having a front top surface above a forward position of a user's foot, and an upper arched region above an arch of the user's foot; and (b) a bottom arch region below the arch of the user's foot;

(2) a laced region extending along the front top surface and upper arched region of said upper, said laced region having laces therealong for securing said shoe to said user's foot and defining a forward laced region on the top front surface and an upper laced arched region on the upper arched region, said forward laced region and upper laced arched region being contiguous to one another;

(3) a bendable sole, said sole having a rear portion and a front portion, the front portion and rear portion lying in separate planes which intersect to form an angle adjacent the bottom arch region, such that when the shoe is in its normal unstressed state the front portion of the sole angles downwardly from the plane containing the rear portion but the sole is sufficiently pliable so that it will become flat under the weight of a wearer; and (4) said laced region of said upper lying substantially in a plane angled downwardly from the plane containing said rear portion of said bendable sole so as to permit facile bending of the user's foot for achieving a desired toe depression for optimum kicking.

2. A kicking shoe as claimed in claim 1, wherein the downward angle is between 5 degrees and 45 degrees.

3. A kicking shoe as claimed in claim 1, wherein the downward angle is between 15 degrees and 45 degrees.

4. A kicking shoe as claimed in claim 1, wherein the downward angle is between 20 degrees and 35 degrees.

5. A kicking shoe as claimed in claim 1, wherein the downward angle is between 30 degrees and 35 degrees.

6. A kicking shoe as claimed in claim 1, where the sole is made of more than one piece.

7. A kicking shoe as claimed in claim 1, wherein said shoe contains an upper attached to said sole, and wherein the downward angle of the front portion of the sole is maintained by said upper.

8. A kicking shoe as claimed in claim 1, wherein said shoe includes an upper attached to said sole, and wherein the downward angle of the front portion of the sole is maintained by the composition and construction of the sole.

9. A kicking shoe as recited in claim 1, wherein said plane of said laced region is angled to achieve a toe depression such as to position the upper laced arched region to contact said sports ball to the exclusion of contact of said forward laced region.

* * * * *